US009246272B2

(12) United States Patent
Kitchen et al.

(10) Patent No.: US 9,246,272 B2
(45) Date of Patent: Jan. 26, 2016

(54) LATCHING CONNECTOR SYSTEM AND ASSOCIATED METHOD

(71) Applicant: ONESUBSEA IP UK LIMITED, London (GB)

(72) Inventors: David Kitchen, Barrow-in-Furness (GB); Allan Nicholson, Barrow-in-Furness (GB)

(73) Assignee: OneSubsea IP UK Limited, London (GB)

( * ) Notice: Subject to any disclaimer, the term of this patent is extended or adjusted under 35 U.S.C. 154(b) by 82 days.

(21) Appl. No.: 14/268,788

(22) Filed: May 2, 2014

(65) Prior Publication Data

US 2015/0318641 A1 Nov. 5, 2015

(51) Int. Cl.
*H01R 13/62* (2006.01)
*H01R 13/641* (2006.01)
*H01R 13/629* (2006.01)

(52) U.S. Cl.
CPC ..... *H01R 13/641* (2013.01); *H01R 13/629* (2013.01)

(58) Field of Classification Search
CPC ..... H01R 13/523; H01R 4/18; H01R 13/62; H01R 4/70
USPC ..... 439/730, 352, 349, 350
See application file for complete search history.

(56) References Cited

U.S. PATENT DOCUMENTS

| | | | | |
|---|---|---|---|---|
| 7,837,518 | B2 * | 11/2010 | Nicholson | H01R 13/523 439/730 |
| 2001/0051452 | A1 * | 12/2001 | Walker | F16L 5/00 439/248 |
| 2007/0020965 | A1 * | 1/2007 | Nicholson | F16L 29/04 439/74 |
| 2007/0184683 | A1 * | 8/2007 | Barber | F16L 1/09 439/74 |
| 2008/0227341 | A1 * | 9/2008 | Nicholson | E21B 33/0385 439/730 |
| 2008/0265563 | A1 * | 10/2008 | Nicholson | H01R 13/523 285/31 |
| 2014/0370735 | A1 * | 12/2014 | Nicholson | H01R 13/523 439/271 |

* cited by examiner

*Primary Examiner* — Abdullah Riyami
*Assistant Examiner* — Nader J Alhawamdeh
(74) *Attorney, Agent, or Firm* — Conley Rose, P.C.

(57) ABSTRACT

A latching connector receptacle includes a receptacle body configured to receive a plug, a biased release ring coupled to the receptacle body, and a latch dog assembly coupled to the receptacle body. The latch dog assembly includes a moveable latch dog configured to matingly engage the plug and matingly engage the release ring, and a moveable latch indicator configured to move in response to movement of the latch dog.

14 Claims, 8 Drawing Sheets

LATCHING CONNECTOR SYSTEM AND ASSOCIATED METHOD

CROSS-REFERENCE TO RELATED APPLICATIONS

None.

BACKGROUND

During deep water or offshore hydrocarbon operations, remote operated vehicles (ROVs) are utilized underwater on an umbilical tether, which provides them with electrical power and control signals. ROVs may carry out varying tasks using hydraulically operated tools and manipulators, and provide visual feedback to an ROV operator through the use of lights and cameras, enabling the ROV to be controlled and operated underwater. For example, an ROV may be used to connect various connectors to allow for electronic, hydraulic, or other types of communication between devices. However, it is challenging for an ROV operator to determine whether successful latching between the connectors has occurred. In particular, such connections are remotely connected and often made in dark and inhospitable environments where visibility is poor. Further, a snag load placed on the hose coupled to the connector after latching may cause the connectors to prematurely decouple.

SUMMARY

To solve the problems noted above, certain embodiments of this disclosure are directed to a latching connector receptacle including a receptacle body configured to receive a plug, a biased release ring coupled to the receptacle body, and a latch dog assembly coupled to the receptacle body. The latch dog assembly includes a moveable latch dog configured to matingly engage the plug and matingly engage the release ring, and a moveable latch indicator configured to move in response to movement of the latch dog.

Other embodiments of this disclosure are directed to a latching connector receptacle including a receptacle body configured to receive a plug, a moveable latch dog coupled to the receptacle body, and a biased release ring slidably coupled to the receptacle body. The release ring includes an end portion configured to slidably engage the moveable latch dog, and a biasing mechanism configured to maintain engagement between the end portion and the latch dog.

Still other embodiments of this disclosure are directed to a latching connector receptacle including a receptacle body configured to receive a plug, a moveable latch dog coupled to the receptacle body, the moveable latch dog configured to slidably engage the plug, and a moveable latch indicator coupled to the receptacle body, the latch indicator moveable in response to slidable engagement of the latch dog with the plug.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

Figure 1:
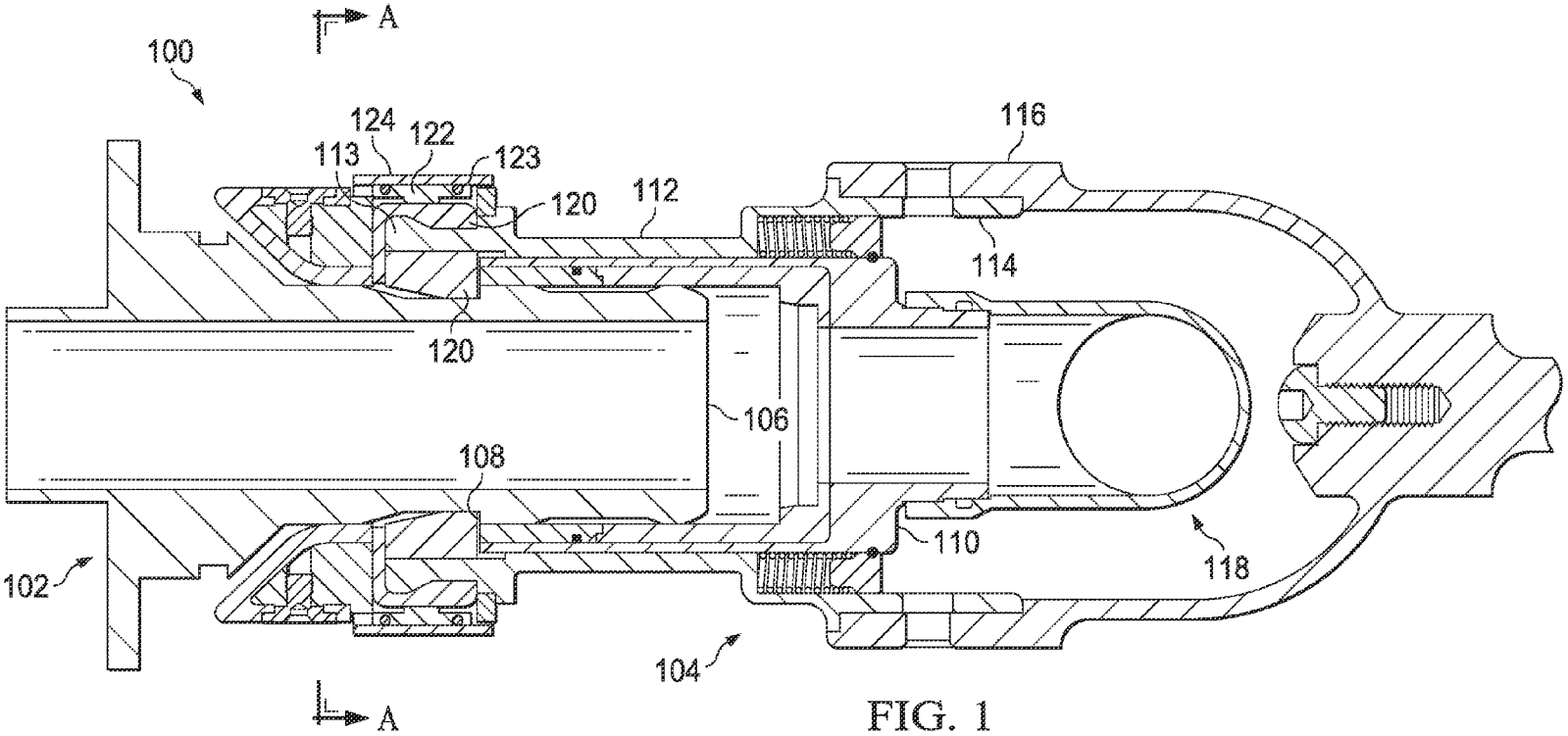
FIG. 1 shows a cross section view of a latching connector system including a plug and a receptacle in accordance with various embodiments.

The particulars shown herein are by way of example, and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere.

The terms "including" and "comprising" are used herein, including in the claims, in an open-ended fashion, and thus should be interpreted to mean "including, but not limited to . . . ." Also, the terms "couple," "connect", "attach" and the like mean either an indirect or direct connection. Thus, if a first component couples or is coupled to a second component, the connection between the components may be through a direct engagement of the two components, or through an indirect connection that is accomplished via other intermediate components, devices and/or connections. In addition, as used herein, including the claims, the terms "axial" and "axially" generally mean along or parallel to a given axis, while the terms "radial" and "radially" generally mean perpendicular to the axis. For instance, an axial distance refers to a distance measured along or parallel to a given axis, and a radial distance means a distance measured perpendicular to the axis.

As explained above, an ROV may be used to join various connectors to allow for electronic, hydraulic, power supply, or other types of communication between devices. For example, a subsea control module may require electric signals and/or hydraulic fluid for operation. A connector (e.g., a plug) is mounted to the subsea control module while a corresponding connector (e.g., a receptacle) is mounted to a conduit that supplies the required hydraulic and/or electronic connections. Other connections such as fiber optic or combinations of types of connections are within the scope of this disclosure. To effect a connection between the subsea control module plug and receptacle, the ROV may grasp the receptacle and guide it into engagement with the plug, at which point the receptacle may be latched to the plug to prevent unintentional separation of the receptacle and the plug.

In accordance with various embodiments, the latching connector receptacle includes a moveable latch indicator that provides a visual indication to an ROV operator of when latching of the receptacle to the plug is in progress (i.e., during a mating procedure when engagement between the receptacle and the plug begins) and when latching is complete. Similarly, the latch indicator provides a visual indication to the ROV operator when the receptacle is unlatched from the plug (i.e., during a release procedure and when the receptacle can be removed from the plug). As a result, it is easier for the ROV operator to visually confirm whether the receptacle has been successfully latched to the plug or whether the receptacle is ready to be removed from the plug, even in situations where visibility is limited. Additionally, the present disclosure is similarly applicable to a case where the connectors comprise a fixed receptacle and a flying plug.

In accordance with other embodiments, the latching connector receptacle includes a biased release ring that prevents unintentional separation from the plug, for example due to a snag load placed on the conduit, such as a jumper harness, coupled to the receptacle. The biased release ring is arranged such that when a sufficient pull force is exerted on the release ring, the receptacle unlatches from the plug and thus can be removed by the ROV operator. However, if a load is applied to the conduit coupled to the receptacle, the release ring remains biased and thus the receptacle remains latched to the plug. These and other embodiments are described in further detail below and with reference to the accompanying figures.

Turning to FIG. 1, a latching connector system 100 is shown in accordance with various embodiments. The latching connector system 100 includes a plug 102 and a receptacle 104, both of which are exemplary connectors. In this embodiment, the plug 102 is coupled to a subsea control module or other subsea device, which may require hydraulic, fiber optic, and/or electronic supply. The plug 102 includes a tip 106 and a plug lip 108. The plug lip 108 has an exterior profile that allows for mating engagement by the receptacle 104, which is described in further detail below. Internal components of the plug 102 are not shown for simplicity.

The receptacle 104 includes a receptacle body 110, which is coupled to a conduit represented by 118, but not shown for simplicity. As explained above, the conduit 118 may be used to contain electronic and/or hydraulic supply lines. The receptacle body 110 also has an open end to receive the plug 102. A latch release ring 112 is coupled to the receptacle body 110 and is able to axially translate relative to the receptacle body, which will be explained in further detail below. The latch release ring 112 comprises a handle mount 114, which serves as a point to which an ROV handle 116 may be coupled. This allows an ROV operator to control and manipulate both the latch release ring 112 and the receptacle body 110, for example to connect the receptacle 104 to the plug 102 or disconnect the receptacle 104 from the plug 102. As shown, the ROV handle 116 is coupled to the receptacle body through the handle mount 114 of the latch release ring 112.

Figure 2:
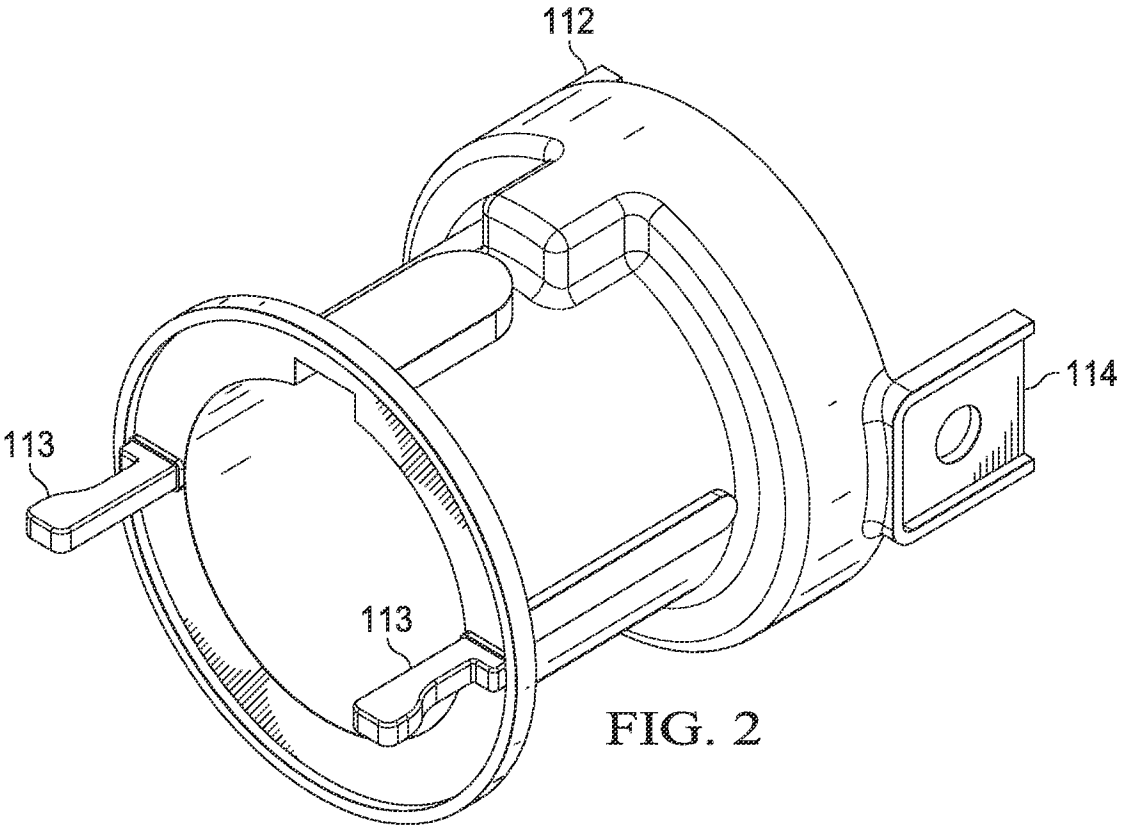
FIG. 2 shows further detail of a release ring of the receptacle in accordance with various embodiments.

The receptacle body 110 is also coupled to a latch dog assembly, which includes latch dogs 120 and a movable latch indicator, which is explained in further detail below. The latch release ring 110 engages an inner profile of the latch dogs 120 as shown. FIG. 2 shows the latch release ring 112 in further detail including fingers 113 that extend from the latch release ring 112 to engage the inner profile of the latch dogs. Turning back to FIG. 1, a latch indicator arm 122, which is biased radially inward by, for example, circlips 123 at least partially surrounds the latch dogs 120 to bias the latch dogs 120 radially inward. In other embodiments, the latch indicator arm 122 may comprise a sprung ring configured to bias the latch dogs 120 radially inward. Other similar components are within the scope of this disclosure. A latch indicator band 124 surrounds the latch indicator arm 122 and the receptacle body 110. The latch indicator band 124 may be made from an elastic material and, in some embodiments, comprises a sealing surface to seal the connection between the receptacle 104 and the plug 102 from the exterior environment. The latch indicator band 124 as well as the engagement and mating of the plug 102 and the receptacle 104 are discussed in further detail below.

Figure 3:
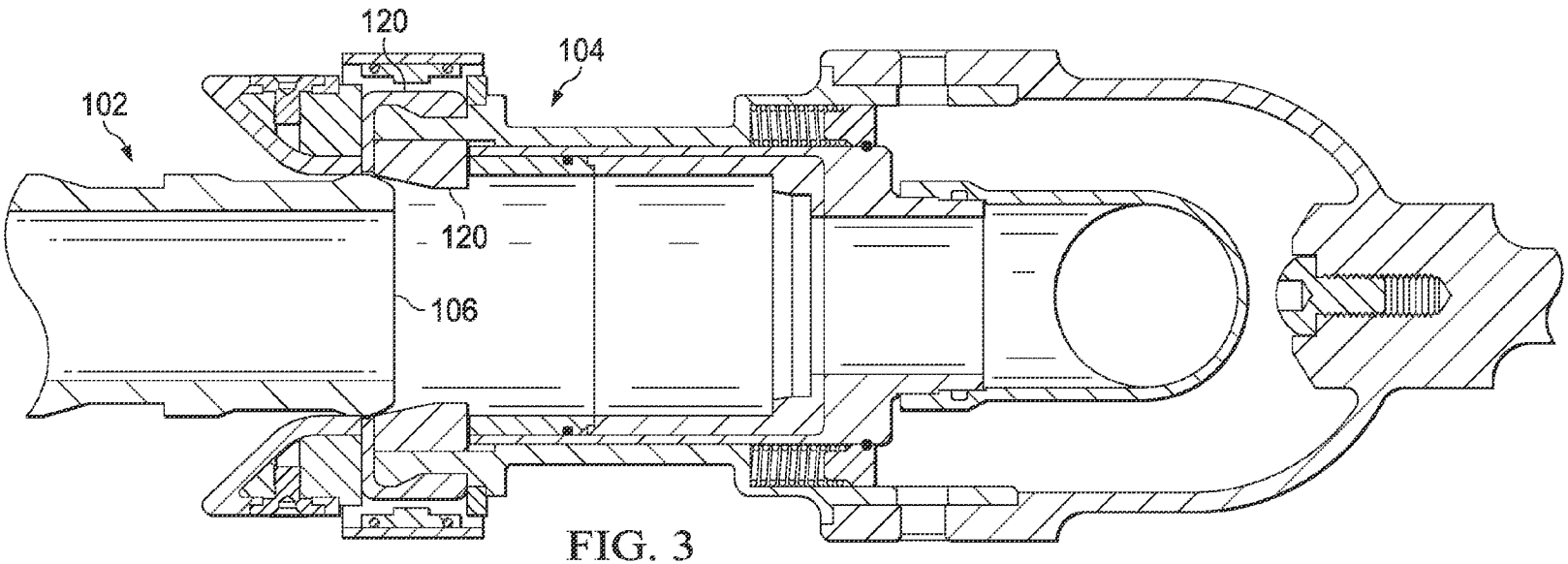
FIG. 3 shows a cross section view of the latching connector system during engagement of the plug and the receptacle in accordance with various embodiments.

FIG. 3 shows the tip 106 of plug 102 entering receptacle 104. As shown, the tip 106 has an exterior profile that engages the latch dogs 120 and begins to urge the latch dogs 120 radially outward.

Figure 4A:
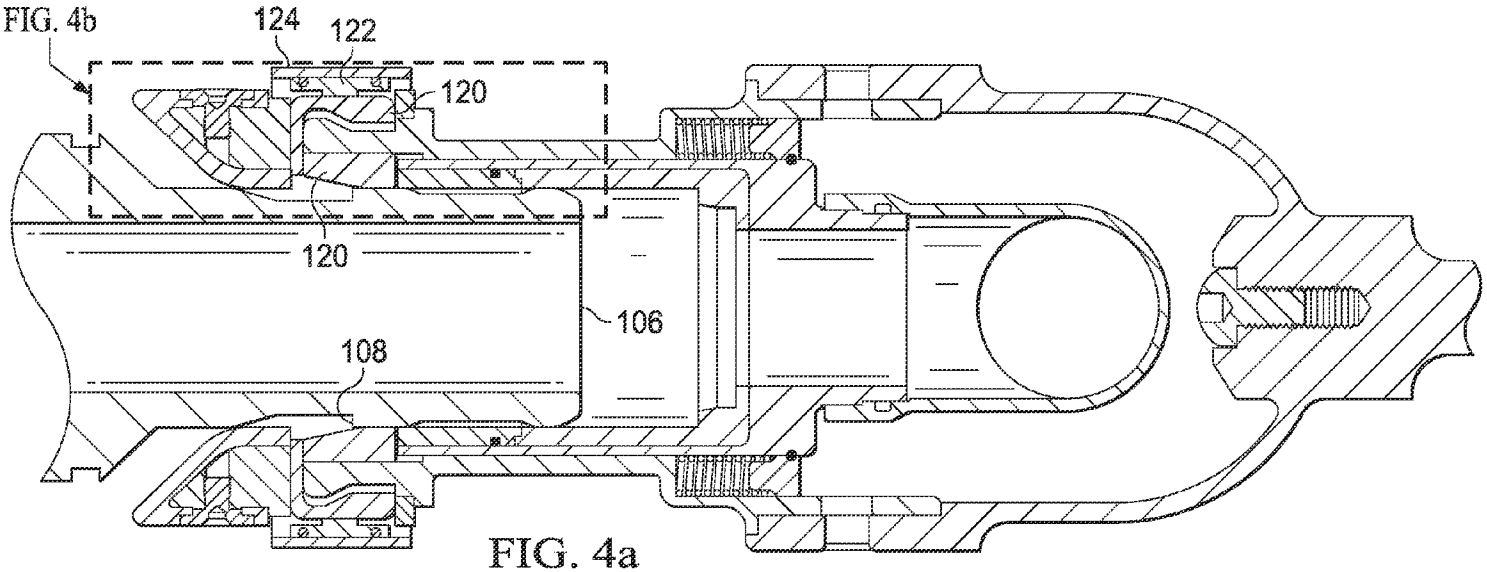
FIG. 4*a* shows a cross section view of the latching connector system during engagement of the plug and the receptacle in accordance with various embodiments.
Figure 4B:
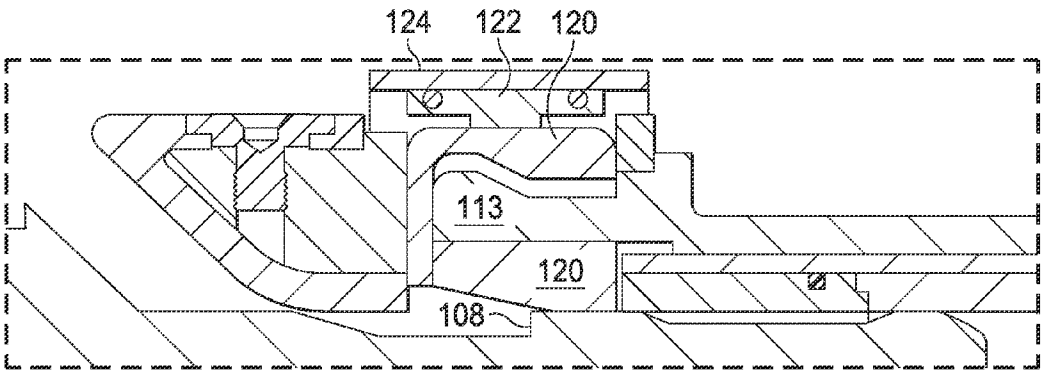
FIG. 4*b* provides a zoomed in view of a portion of FIG. 4*a* in further detail.

FIG. 4*a* shows the plug 102 and the receptacle 104 during mating engagement. The exterior profile of the plug lip 108 similarly engages the latch dogs 120 urging the latch dogs 120 radially outward. As shown, the latch dogs 120 being urged radially outward causes the latch indicator arm 122 to likewise be urged radially outward and places the latch indicator band 124 under an increased tension. FIG. 4*b* shows a zoomed in view of the interface between the plug lip 108, the latch dogs 120, the latch indicator arm 122, and the latch indicator band 124. Further, the interior profile of the latch dogs 120 is such that the latch dogs 120 can move radially inward and outward while maintaining a clearance around the finger 113 of the release ring 114, which in some cases engages the inner profile of the latch dogs 120. As explained in further detail below, this movement of the latch dogs 120 induces a corresponding movement in a latch indicator, which is clearly visible to an ROV operator via, for example, a camera mounted on the ROV.

Figure 5:
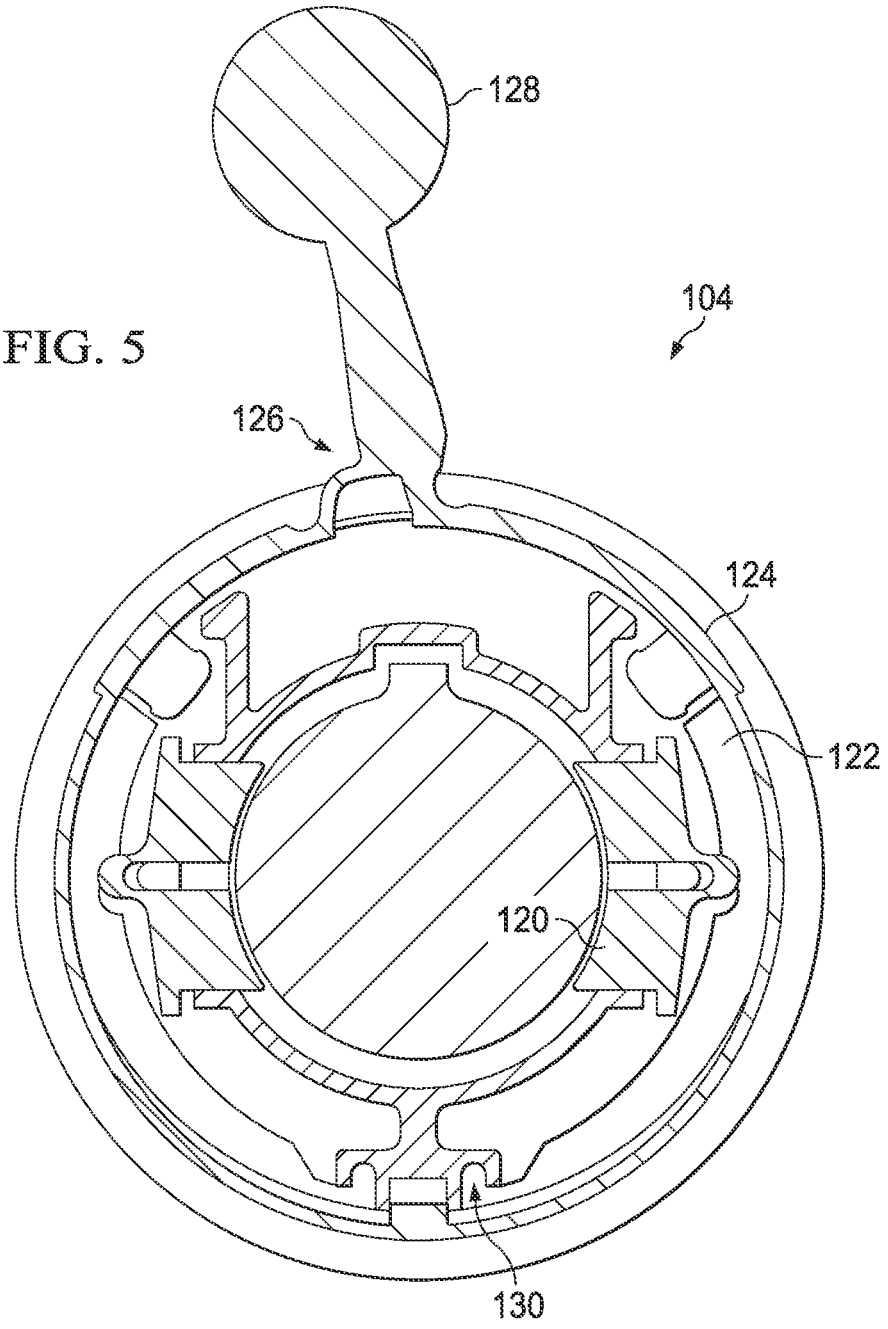
FIG. 5 shows an exemplary latch indicator of the receptacle in accordance with various embodiments.

FIG. 5 shows a view of the receptacle 104 taken along the section A shown in FIG. 1. As can be seen, upon radial movement outward, the latch dogs 120 engage a portion of the latch indicator arm 122, which causes the latch indicator arm to pivot radially outward. A pivot point 130 is an exemplary coupling between the latch indicator arm 122 and the receptacle body 110. When the latch indicator arm 122 pivots outward, the latch indicator band 124, which is elastic, is placed under an increased tension.

In accordance with various embodiments, the latch indicator band 124 comprises a latch amplification portion 126, which is shaped such that an increase in tension of the latch indicator band 124 causes a corresponding movement of a latch indicator 128. For example, as shown, when the latch indicator band 124 is placed under an increased tension, the latch indicator 128 is "pulled" to the side of the latch amplification portion 126. In this way, movement of the latch dogs 120 is translated into a movement of the latch indicator 128.

Figure 6:
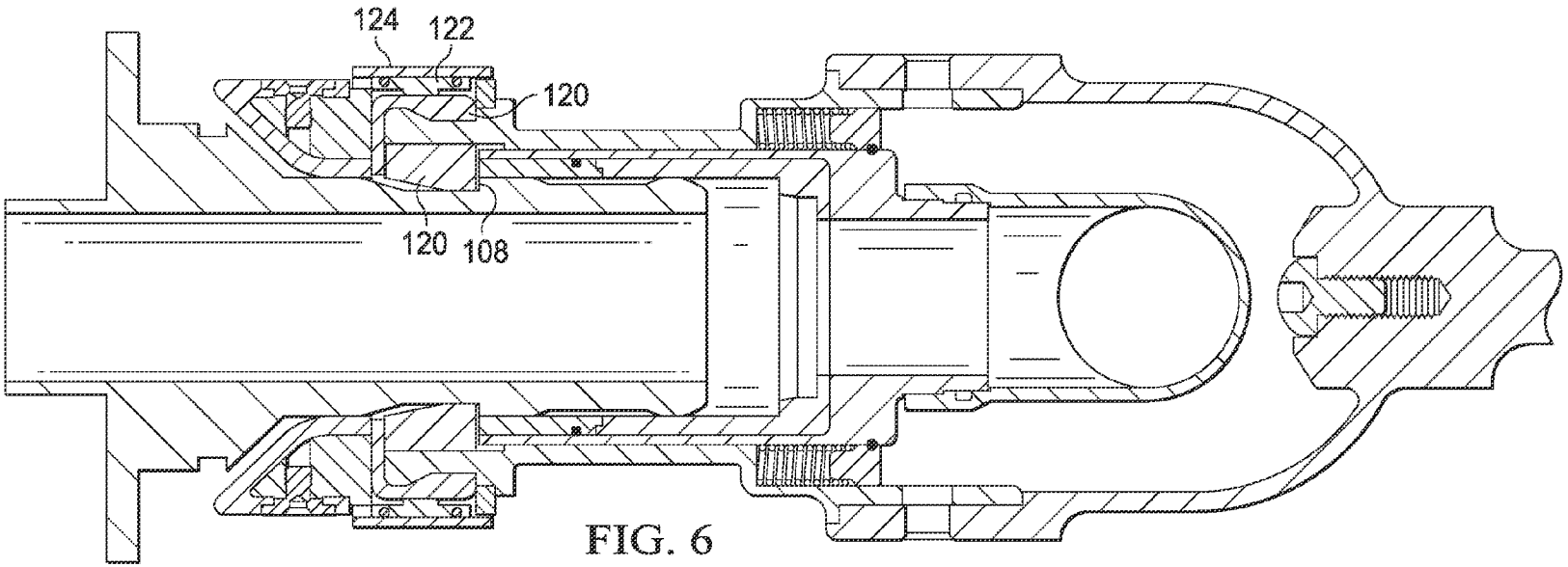
FIG. 6 shows a cross section view of the latching connector system after mating of the plug and the receptacle in accordance with various embodiments.

As explained above, the latch dogs 120 are urged radially outward as a result of contact with the exterior profile of the plug 102 during a mating procedure. Thus, prior to mating, the latch indicator 128 is in a first position (e.g., upright), while during mating, the latch indicator 128 moves to a second position (e.g., pulled to the side) as a result of the latch dogs 120 being urged radially outward and inducing an increase in tension of the latch indicator band 124. Then, when the plug 102 and the receptacle 104 are in a mated configuration as shown in FIG. 6, the latch dogs 120 are urged back radially inward by the biased latch indicator arms 122. The latch dogs 120 engage the lip 108 of the plug 102 to prevent separation of the receptacle 104 from the plug 102, for example in the event that a snag force is applied to the conduit 118. Further, the latch dogs 120 moving radially inward results in a decrease in tension of the latch indicator band 124 and a corresponding return of the latch indicator 128 to the first position. In this way, the ROV operator is provided with visual confirmation of engagement of the plug 102 as well as when the receptacle 104 has successfully mated with the plug 102. The visual confirmation is easy to perceive even in harsh subsea environments.

Figure 7A:
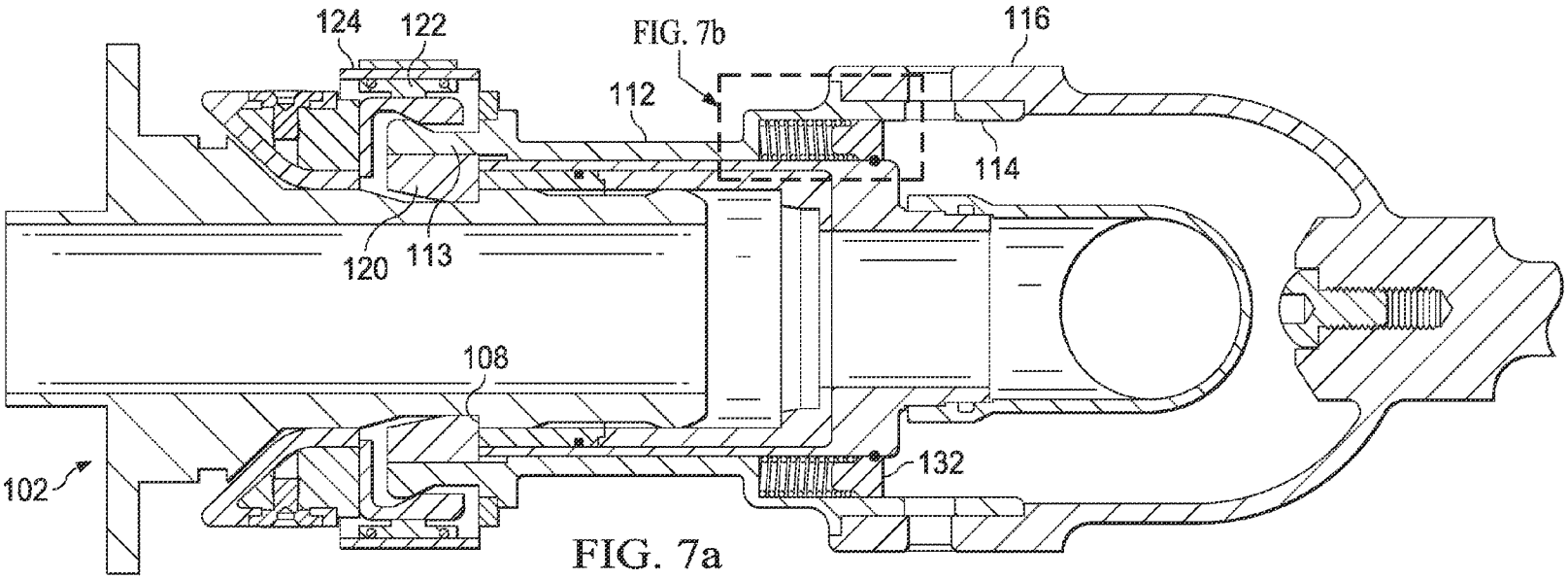
FIG. 7*a* shows a cross section view of the latching connector system with a pull force applied to the release ring prior to disengagement in accordance with various embodiments.
Figure 7B:
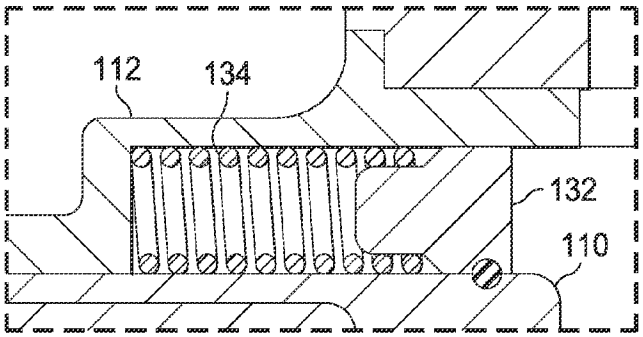
FIG. 7*b* provides a zoomed in view of a portion of an exemplary biasing mechanism of FIG. 7*a* in further detail.

Turning now to FIGS. 7*a* and 7*b*, a disengagement configuration and method are described. As explained above, the latch dogs 120 engaging the lip 108 of the plug 102 prevents separation of the receptacle 104 from the plug 102, for example in the event that a snag force is applied to the conduit 118. However, it is advantageous to separate the receptacle 104 from the plug in certain situations, for example during a subsea intervention that requires retrieval of a subsea control module.

In accordance with various embodiments, the ROV operator may apply a pull force to the release ring 112 through the coupling of the handle mount 114 to the ROV handle 116. As shown in FIG. 7*b*, the release ring 112 is biased against such a pull force by a spring 134 mounted to a fixed element 132 relative to the receptacle body 110. In the biased configuration, the release ring 112 allows movement of various components as described above. However, when a sufficient pull force is applied to the release ring 112, the release ring engages an inner profile of the latch dogs 120. In particular, as shown, the fingers 113 engage the inner profile of the latch dogs 120, and the mating profile is such that this engagement results in the latch dogs 120 being urged radially outward and out of engagement with the lip 108 of the plug 102. Additionally, as above, the latch dogs 120 being urged radially outward causes the latch indicator 128 to be displaced into the second position, providing visual confirmation to the ROV operator that the latch dogs 120 are free of the plug lip 108 and the receptacle 104 can be removed from the plug 102. Because the release ring 110 is biased in a way such that the latch dogs 120 are typically engaging the plug lip 108 when the connectors 102, 104 are mated, accidental disconnection is avoided while purposeful disconnection is readily achieved through the deliberate application of a pull force to the release ring 110. Further, the latch indicator 128 provides visual assurance to the ROV operator that the latch dogs 120 are free of the plug lip 108 and thus that the receptacle 104 may be separated from the plug 102.

Figure 8:
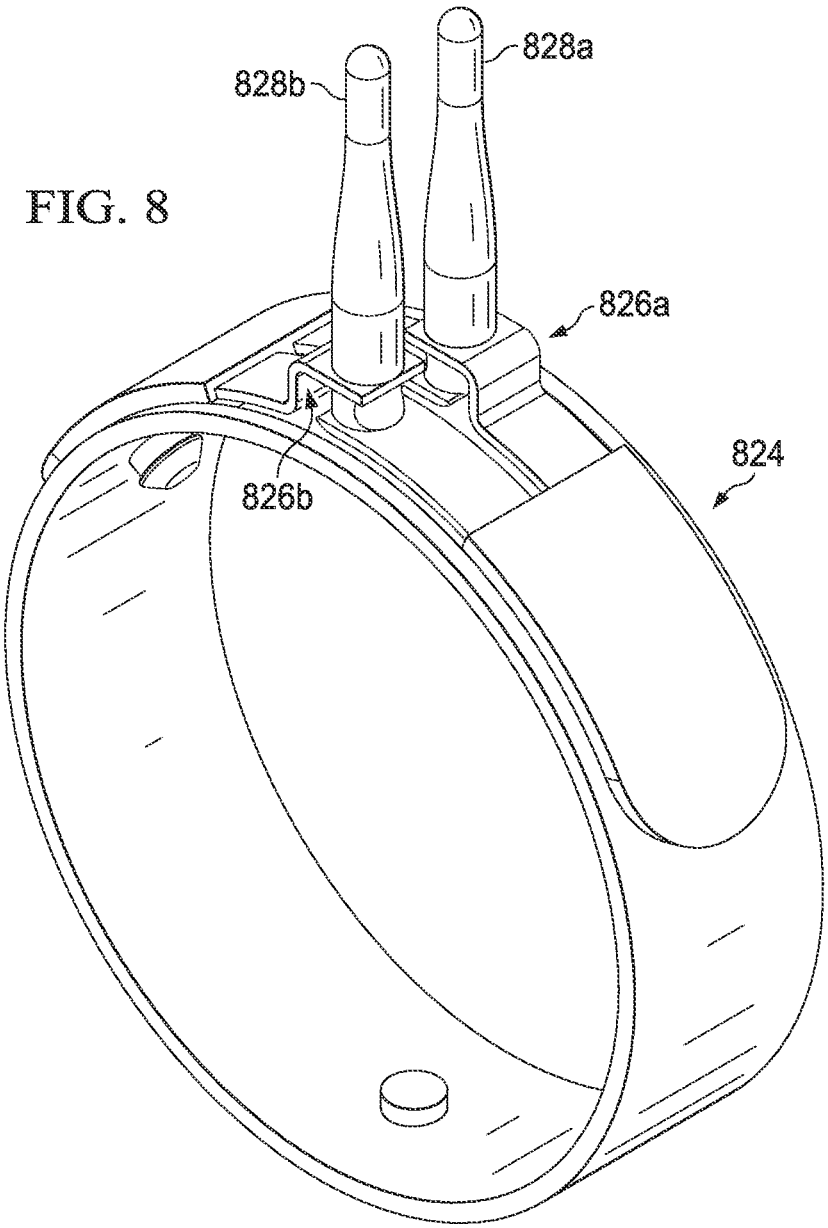
FIG. 8 shows an alternate latch indicator band and latch indicator in accordance with various embodiments.

FIG. 8 shows an alternate latch indicator band 824 in accordance with various embodiments. The latch indicator band 824 comprises a first latch amplification portion 826*a* and a second latch amplification portion 826*b*, which are shaped such that an increase in tension of the latch indicator band 824 causes a corresponding movement of a first latch indicator 828*a* and a second latch indicator 828*b*, respectively. For example, as shown, when the latch indicator band 824 is placed under an increased tension, the latch indicators 828*a-b* are "pulled" apart from one another and thus move in differing directions. In this way, movement of the latch dogs 120 is translated into a movement of the latch indicators 828*a-b*.

As explained above, the latch dogs 120 are urged radially outward as a result of contact with the exterior profile of the plug 102 during a mating procedure. Thus, prior to mating, the latch indicators 828*a-b* are in a first position (e.g., upright and together), while during mating, the latch indicators 828*a-b* move to a second position (e.g., displaced apart from one another) as a result of the latch dogs 120 being urged radially outward and inducing an increase in tension of the latch indicator band 824. Then, when the plug 102 and the receptacle 104 are in a mated configuration as shown in FIG. 6, the latch dogs 120 are urged back radially inward by the biased latch indicator arms 122. The latch dogs 120 moving radially inward results in a decrease in tension of the latch indicator band 824 and a corresponding return of the latch indicators 828*a-b* to the first position. In this way, the ROV operator is provided with visual confirmation of engagement of the plug 102 as well as when the receptacle 104 has successfully mated with the plug 102. The visual confirmation is easy to perceive even in harsh subsea environments.

Various methods associated with the use of the disclosed latching connector system are also within the scope of this disclosure. For example, methods directed to operating an ROV to connect a receptacle to a corresponding plug (or vice versa, in the case of a fixed receptacle and a flying plug), which may be visually confirmed by observing the latch indicator, are within the scope of this disclosure. Similarly, methods directed to operating an ROV to disconnect the receptacle from the plug are also within the scope of this disclosure. In particular, a method of disconnection where first a pull force is applied to a release ring to disengage the plug, which is visually confirmed by observing the latch indicator, and then the receptacle is removed from the plug once disengagement has been visually confirmed, is within the scope of this disclosure.

Furthermore, in some embodiments, a latching connector receptacle body that has a latch dog assembly with a moveable latch dog is capable of matingly engaging both a slidable plug and a slidable, biased release ring. Consequently, an assembly is provided that includes both a plug releasably coupled to the latch dog and a release ring releasably coupled to the latch dog. The release ring can be moved to then move the latch dog relative to the plug. Additionally, the latch dog can be moved to then move the latch indicator. Various movements of the latch dog translate to corresponding movement of the latch indicator between various positions.

In still further embodiments, a latching connector receptacle body has a moveable latch dog that is capable of slidably engaging an end portion of a release ring, wherein the release ring is axially biased to maintain engagement between the end portion and the latch dog. An axial force, such as along the axis of the receptacle body and a plug receivable therein, can be used to overcome the axial biasing of the release ring and slidably engage the end portion with the latch dog thereby radially moving the latch dog. Axial displacement of the release ring away from the plug causes the release ring to engage an interior profile of the latch dog, which urges the latch dog radially outward and out of engagement with the plug.

In still other embodiments, a latching connector receptacle body has a moveable latch dog capable of slidably engaging a plug, and a moveable latch indicator that is moveable in response to slidable engagement of the latch dog with the plug. As the plug slidably engages the latch dog, the latch dog is moved radially and thereby moves the latch indicator to various positions corresponding to the axial position of the plug relative to the latch dog.

While the subject disclosure is described through the above embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A latching connector receptacle comprising:

a receptacle body configured to receive a plug;

a biased release ring coupled to the receptacle body; and a latch dog assembly coupled to the receptacle body, the latch dog assembly comprising:

a moveable latch dog configured to matingly engage the plug, and matingly engage the release ring; and a moveable latch indicator configured to move in response to movement of the latch dog;

further comprising a latch indicator band coupled to a first latch indicator, wherein the latch indicator band extends radially around the latch dog assembly, and wherein a first latch amplification portion of the latch indicator band causes displacement of the first latch indicator in response to an increase in tension of the latch indicator band;

wherein a second latch amplification portion of the latch indicator band causes displacement of a second latch indicator coupled to the latch indicator band in response to an increase in tension of the latch indicator band, and wherein the displacement of the second latch indicator is in a different direction than the displacement of the first latch indicator.

2. The latching connector receptacle of claim 1 wherein:

the latch dog is configured to be urged radially outward in response to engagement with a surface of the plug; and the latch indicator band is placed under increased tension in response to the latch dog being urged radially outward.

3. The latching connector receptacle of claim 1 wherein the latch indicator band is under an increased tension during a mating procedure and during a release procedure.

4. The latching connector receptacle of claim 3 wherein:

during the mating procedure, the latch dog is urged radially outward in response to engagement with the surface of the plug; and during the release procedure, the latch dog is urged radially outward in response to engagement between the release ring and an interior profile of the latch dog.

5. The latching connector receptacle of claim 1 wherein axial displacement of the release ring away from the plug causes the release ring to engage an interior profile of the latch dog, which urges the latch dog radially outward and out of engagement with a lip of the plug.

6. The latching connector receptacle of claim 5 wherein the release ring is biased toward the plug by a spring such that a force required for axial displacement of the release ring is greater than a spring force of the spring.

7. The latching connector receptacle of claim 5 wherein a pull force applied to a mounting assembly of the release ring causes axial displacement of the release ring away from the plug.

8. A latching connector receptacle comprising:

a receptacle body configured to receive a plug;

a moveable latch dog coupled to the receptacle body; and a biased release ring slidably coupled to the receptacle body, the release ring comprising:

an end portion configured to slidably engage the moveable latch dog; and a biasing mechanism configured to maintain engagement between the end portion and the latch dog;

wherein axial displacement of the release ring away from the plug causes the release ring to engage an interior profile of the latch dog, which urges the latch dog radially outward and out of engagement with the lip of the plug.

9. The latching connector receptacle of claim 8 wherein the biasing mechanism comprises a spring such that a force required for axial displacement of the release ring is greater than a spring force of the spring.

10. The latching connector receptacle of claim 8 wherein a pull force applied to a mounting assembly of the release ring causes axial displacement of the release ring away from the plug.

11. A latching connector receptacle comprising:

a receptacle body configured to receive a plug;

a moveable latch dog coupled to the receptacle body, the moveable latch dog configured to slidably engage the plug; and a moveable latch indicator coupled to the receptacle body, the latch indicator moveable in response to slidable engagement of the latch dog with the plug;

further comprising a latch indicator band coupled to a first latch indicator, wherein the latch indicator band extends radially around the latch dog, and wherein a first latch amplification portion of the latch indicator band causes displacement of the first latch indicator in response to an increase in tension of the latch indicator band;

wherein a second latch amplification portion of the latch indicator band causes displacement of a second latch indicator coupled to the latch indicator band in response to an increase in tension of the latch indicator band, and wherein the displacement of the second latch indicator is in a different direction than the displacement of the first latch indicator.

12. The latching connector receptacle of claim 11 wherein:

the latch dog is configured to be urged radially outward in response to engagement with a surface of the plug; and the latch indicator band is placed under increased tension in response to the latch dog being urged radially outward.

13. The latching connector receptacle of claim 11 wherein the latch indicator band is under an increased tension during a mating procedure and during a release procedure.

14. The latching connector receptacle of claim 13 wherein:

during the mating procedure, the latch dog is urged radially outward in response to engagement with the surface of the plug; and during the release procedure, the latch dog is urged radially outward in response to engagement between a release ring and an interior profile of the latch dog.

* * * * *